US009689107B2

(12) United States Patent
Joo

(10) Patent No.: US 9,689,107 B2
(45) Date of Patent: Jun. 27, 2017

(54) APPARATUS AND METHOD FOR DETECTING AN ERROR IN THE MEASUREMENT OF A WATER LEVEL IN A WASHING MACHINE

(75) Inventor: Sung Su Joo, Bucheon-si (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 193 days.

(21) Appl. No.: 14/117,839

(22) PCT Filed: May 15, 2012

(86) PCT No.: PCT/KR2012/003802
§ 371 (c)(1),
(2), (4) Date: Nov. 14, 2013

(87) PCT Pub. No.: WO2012/157942
PCT Pub. Date: Nov. 22, 2012

(65) Prior Publication Data

US 2014/0174547 A1 Jun. 26, 2014

(30) Foreign Application Priority Data

May 17, 2011 (KR) ..... 10-2011-0046249

(51) Int. Cl.
*A47L 15/42* (2006.01)
*F16K 21/18* (2006.01)
(Continued)

(52) U.S. Cl.
CPC ..... *D06F 39/087* (2013.01); *A47L 15/0049* (2013.01); *D06F 33/02* (2013.01);
(Continued)

(58) Field of Classification Search
CPC ..... Y10T 137/7287; Y10T 137/729; Y10T 137/7303; Y10T 137/731; Y10T 137/7313;
(Continued)

(56) References Cited

U.S. PATENT DOCUMENTS 4,184,347 A * 1/1980 Tobita ..... D06F 33/02 137/387
4,245,310 A * 1/1981 Kiefer ..... D06F 33/02 134/57 D
(Continued)

FOREIGN PATENT DOCUMENTS

| | | | |
|---|---|---|---|
| JP | 2003071185 | A | 3/2003 |
| KR | 100753445 | B1 | 8/2007 |
| KR | 1020090063372 | A | 6/2009 |

OTHER PUBLICATIONS

Mi Ra Kim, et al., Korean Patent Abstract, Abstract of Registration No. 1007534450000, Publication Date Aug. 31, 2007, 2 pages, Korean Intellectual Property Rights Information Service, Republic of Korea.
(Continued)

*Primary Examiner* — Mary McManmon
*Assistant Examiner* — Hailey K Do

(57) ABSTRACT

An apparatus for detecting an error in the measurement of a water level in a washing machine includes a water level sensor measuring a water level in a washing tub; a water supply and drain device supplying water to the washing tub or discharging water from in the washing tub; and a control unit controlling the water supply and drain device to adjust the water level in the washing tub, and detecting a measurement error of the water level sensor based on a water level change measured by the water level sensor while the water level is adjusted.

2 Claims, 5 Drawing Sheets

(51) Int. Cl.

| | |
|---|---|
| ***G05D 9/12*** | (2006.01) |
| ***B01D 3/42*** | (2006.01) |
| ***F16K 31/20*** | (2006.01) |
| ***D06F 39/08*** | (2006.01) |
| ***D06F 33/02*** | (2006.01) |
| ***A47L 15/00*** | (2006.01) |
| ***D06F 37/42*** | (2006.01) |
| ***D06F 39/00*** | (2006.01) |

(52) U.S. Cl.

CPC ..... *D06F 37/42* (2013.01); *D06F 39/005* (2013.01); *D06F 39/083* (2013.01); *D06F 39/088* (2013.01); *A47L 15/4244* (2013.01); *A47L 2401/09* (2013.01); *A47L 2501/01* (2013.01); *A47L 2501/02* (2013.01); *D06F 2202/085* (2013.01); *D06F 2204/084* (2013.01); *D06F 2204/086* (2013.01); *Y10T 137/0324* (2015.04); *Y10T 137/729* (2015.04); *Y10T 137/7303* (2015.04); *Y10T 137/7306* (2015.04); *Y10T 137/7313* (2015.04)

(58) Field of Classification Search

CPC ..... Y10T 137/7306; Y10T 137/8342; Y10T 137/7491; Y10T 137/7494; G05D 9/00; G05D 9/02; G05D 9/04; G05D 9/12

USPC ..... 137/387, 392, 395, 389, 391; 73/1.73, 73/302, 304, 307, 308, 312, 292; 68/208

See application file for complete search history.

(56) References Cited

U.S. PATENT DOCUMENTS

| | | | | |
|---|---|---|---|---|
| 4,982,606 | A * | 1/1991 | Adamski | D06F 39/087 137/387 |
| 5,159,823 | A * | 11/1992 | Fukuda | D06F 39/087 137/387 |
| 5,363,471 | A * | 11/1994 | Jones | F22B 1/30 219/483 |
| 2006/0065040 | A1* | 3/2006 | Grunwald | G01F 25/0061 73/1.73 |
| 2010/0175718 | A1* | 7/2010 | Kedjierski | A47L 15/4244 134/18 |
| 2011/0023919 | A1* | 2/2011 | Kaltofen | A47L 15/4244 134/56 D |
| 2012/0000535 | A1* | 1/2012 | Poyner | A47L 15/0049 137/1 |

OTHER PUBLICATIONS

Sung Hoon Kim, et al. Espacenet Bibliographic Data: Abstract of KR20090063372 A, Jun. 18, 2009, 1 page, European Patent Office, http://worldwide.espacenet.com.

Toshiyuki Uchiyama, et al., Espacenet Bibliographic Data: Abstract of JP2003071185 A, Mar. 11, 2003, 2 pages, European Patent Office, http://worldwide.espacenet.com.

Written Opinion and International Search Report dated Nov. 23, 2012, International application No. PCT/KR2012/003802, Korean Intellectual Property Office, Republic of Korea.

* cited by examiner

APPARATUS AND METHOD FOR DETECTING AN ERROR IN THE MEASUREMENT OF A WATER LEVEL IN A WASHING MACHINE

TECHNICAL FIELD

The present invention relates to a washing machine, and more particularly, to an apparatus and method for detecting an error in the measurement of a water level sensor based on water level changes measured by the water level sensor, while an actual water level in a washing tub is adjusted.

BACKGROUND ART

Washing machines perform washing, rinsing, and spin-drying processes using water, detergent, and mechanical force, and remove stains from laundry items placed in the washing tub.

When water is introduced into the bottom of the washing tub of the washing machine, the water is also introduced into an air chamber. The water introduced into the air chamber fills the air chamber at the same level as the water in the washing tub.

The air within the air chamber is compressed by the volume of the water introduced into the air chamber, and the compressed air is transferred to a water level sensor through an air trap. The water level sensor measures the water level in the washing tub according to the pressure of the transferred air.

According to a conventional washing process, the water level of the washing tub is measured at the initial stage of the washing process, and water is supplied or discharged at a necessary level so as to perform the washing process. Alternatively, the water in the washing tub is completely discharged, and water is then resupplied to perform the washing process.

However, when water remaining in the air trap is frozen in the winter season due to a very low temperature around the washing machine, the pressure of air transferred to the water level sensor changes. Therefore, the water level measured by the water level sensor may be different from the actual water level in the washing tub.

When the water level measured by the water level sensor is different from the actual water level in the washing tub, water may not be supplied or discharged at a level adequate to perform the washing process. In this case, the washing process may not be performed properly.

Furthermore, when the water level is measured by the water level sensor incorrectly determines that the washing water level is equal to or higher than the actual washing water level even though no water exists in the washing tub, a heater may begin operating when there is no water in the washing tub. In this case, a fire may occur.

Furthermore, although water is completely discharged and then resupplied, all of the water containing dissolved detergent is discharged when a user powers the washing machine on or off, as occasion demands. Therefore, water and detergent may be wasted.

The above-described configuration is a disclosure of related art for helping with the understanding of the present invention, and does not mean a related art which is widely known in the technical field to which the present invention pertains.

DISCLOSURE

Technical Problem

The present invention is conceived or created to solve such problems of the related art, and an aspect of the invention provides an apparatus and a method for detecting an error in the measurement of a water level in a washing machine, which is capable of detecting a measurement error of a water level sensor, based on water level changes measured by the water level sensor, while an actual water level in the washing tub is adjusted.

Technical Solution

According to an aspect of the invention, an apparatus for detecting an error in the measurement of a water level in a washing machine includes a water level sensor measuring a water level in a washing tub; a water supply and drain device supplying water into the washing tub and/or discharging water from the washing tub; and a control unit (i) controlling the water supply and drain device to adjust the water level in the washing tub, and (ii) detecting a measurement error of the water level sensor based on a water level change measured by the water level sensor while the water level is adjusted.

The control unit may control or adjust the water supply and drain device for a preset time, and may detect a measurement error of the water level sensor when a water level difference before and after the preset time is less than a reference value.

The control unit may control the water supply and drain device, and detect a measurement error of the water level sensor when the water level measured by the water level sensor in real time has not changed.

The control unit may compare a first water level measured by the water level sensor to a preset water level, and control the water supply and drain device to discharge the water from the washing tub when the first water level is higher than the preset water level, or control the water supply and drain device to supply water to the washing tub when the first water level is equal to or lower than the preset water level.

According to another aspect of the invention, a method for detecting an error in a measurement of a water level in a washing machine includes receiving in a control unit a water level in a washing tub from a water level sensor; adjusting the water level in the washing tub by controlling a water supply and drain device and supplying water to the washing tub or discharging water from the washing tub when water is in the washing tub; and detecting a measurement error of the water level sensor from a water level change measured by the water level sensor.

Adjusting the water level in the washing tub may include comparing a first water level measured by the water level sensor to a preset water level; and selectively controlling the water supply and drain device to supply water to the washing tub or discharge water from the washing tub according to the comparison result.

In controlling the water supply and drain device, when the first water level is higher than the preset water level, the water in the washing tub may be discharged, and when the first water level is equal to or lower than the preset water level, additional water may be supplied to the washing tub.

Detecting the measurement error of the water level sensor may include calculating a water level difference before and after adjusting the water level; and outputting a measurement error of the water level sensor when the water level difference is less than a reference level.

Detecting the measurement error may include receiving the water level in the washing tub from the water level sensor in real time, while adjusting the water level; and outputting a measurement error of the water level sensor when the water level from the water level sensor in real time is unchanged.

Advantageous Effects

According to an embodiment of the invention, when water remaining in the air trap is frozen, or the pressure of the air trap has changed, the control unit may control an output unit to display that the water level measured by the water level sensor is different from the actual water level in the washing tub, thereby informing a user of the measurement error of the water level sensor.

Furthermore, when the measurement error of the water level sensor is detected, the control unit may stop the washing process, thereby reducing the waste of water and detergent, which may occur as the washing process is performed.

Furthermore, it is possible to prevent a heater from operating when water is not supplied or when no water exists in the washing tub. Thus, it is possible to prevent a risk of fire.

Furthermore, the first water level measured by the water level sensor may be compared to a preset water level to detect the measurement error of the water level sensor, and supplying or discharging water may be selectively performed. Thus, it is possible to reduce the amount of water used.

DESCRIPTION OF DRAWINGS

The above and other aspects, features and advantages of the invention will become apparent from the following detailed description in conjunction with the accompanying drawings, in which.

DETAILED DESCRIPTION

Embodiments of the present invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
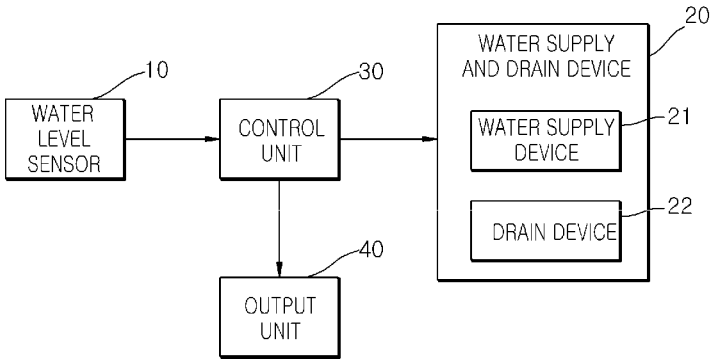
FIG. 1 is a block configuration diagram of an apparatus for detecting an error in the measurement of a water level in a washing machine in accordance with an embodiment of the present invention.

FIG. 1 is a block configuration diagram of an apparatus for detecting an error in the measurement of a water level in a washing machine in accordance with an embodiment of the present invention.

Figure 2:
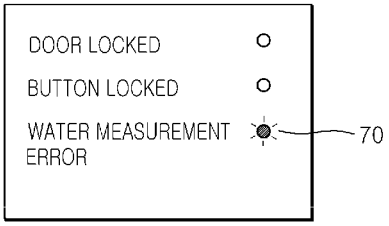
FIG. 2 is a diagram illustrating a measurement error lamp for an apparatus for detecting an error in the measurement of a water level in a washing machine in accordance with an embodiment of the present invention.
Figure 3:
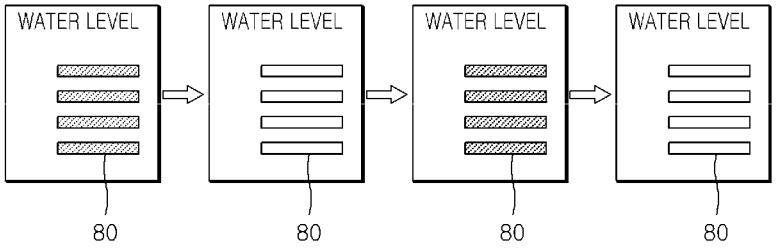
FIG. 3 is a diagram illustrating a flickering method in a water level display window to display a measurement error for an apparatus for detecting an error in the measurement of a water level in a washing machine in accordance with an embodiment of the present invention.
Figure 4:
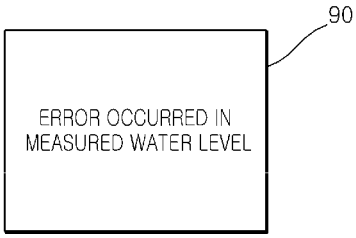
FIG. 4 is a diagram illustrating an LED window displaying a measurement error notice for an apparatus for detecting an error in the measurement of a water level in a washing machine in accordance with an embodiment of the present invention.

FIG. 2 is a diagram illustrating a measurement error lamp for an apparatus for detecting an error in the measurement of a water level in a washing machine in accordance with an embodiment of the present invention. FIG. 3 is a diagram illustrating a flickering method in a water level display window to display a measurement error for an apparatus for detecting an error in the measurement of a water level in a washing machine in accordance with an embodiment of the present invention. FIG. 4 is a diagram illustrating an LED window displaying a measurement error for an apparatus for detecting an error in the measurement of a water level in a washing machine in accordance with an embodiment of the present invention.

Referring to FIG. 1, an apparatus for detecting a water level measurement error in a washing machine in accordance with an embodiment of the present invention includes a water level sensor 10, a water supply and drain device 20, a control unit 30, and an output unit 40.

The water level sensor 10 measures a water level in a washing tub (not illustrated) and transfers the measured water level to the control unit 30.

When water is introduced into the washing tub, water is also introduced into an air chamber (not illustrated) at the same level as the water introduced into the washing tub. The air in the air chamber is compressed by the volume of the introduced water, and the compressed air is transferred to the water level sensor 10 through an air trap (not illustrated).

The water level sensor 10 outputs a frequency corresponding to the pressure of the air transferred through the air trap. The frequency from the water level sensor 10 corresponds to the water level in the washing tub, which is measured by the water level sensor 10. Thus, throughout the present specification, the term "water level" may be interchangeable with the term "frequency".

The water supply and drain device 20 includes a water supply device 21 and a drain device 22.

The water supply device 21 serves to supply water into the washing tub, and may include a water supply valve (not illustrated) to control the supplied water and a water supply pipe corresponding to a flow path through which the water is supplied. The water supply device 21 includes various types of devices to supply water.

The drain device 22 serves to discharge water from the washing tub, and may include a drain valve to control the discharged water, a drain pipe corresponding to a flow path through which the water is discharged, and a drain pump to discharge the water. The drain device 22 includes various types of devices to discharge water.

The control unit 30 serves to detect a measurement error of the water level sensor 10 based on a water level change measured by the water level sensor 10, while controlling the water supply and drain device 20 to adjust an actual water level in the washing tub.

Specifically, when it is determined by the water level sensor that water is in the washing tub, the control unit 30 operates the drain device 22 to discharge the water from the washing tub for a preset time, and receives water levels before and after the preset time from the water level sensor 10.

The preset time during which the drain device 22 is operated to discharge water from the washing tub may be selected in various manners by a user or according to the designer's intention.

Then, the control unit 30 calculates a difference between the measured water level before the preset time and the measured water level after the preset time from the water level sensor 10, and compares the calculated level difference to a preset reference value. That is, the control unit 30 calculates a difference before and after the water is discharged, and compares the calculated level difference to the reference value.

The reference value is a minimum water level difference at which it may be determined that the water level sensor 10 is normally measuring a water level when the drain device 22 discharges water from the washing tub, and may be selected in various manners by the user or according to the designer's intention.

When the water level difference before and after the preset time is less than the reference value, it may indicate that the water level sensor 10 does not measure the actual water level change. Thus, the control unit 30 causes the output unit 40 to display a measurement error of the water level sensor 10.

On the other hand, when the level difference before and after the preset time is equal to or greater than the reference value, it may indicate that the water level sensor 10 normally measures the water level. Thus, the control unit 30 controls the water supply and drain device 20 to supply or discharge water at a level for washing, and then performs a washing operation.

In the present embodiment, a case in which the control unit 30 detects a measurement error of the water level sensor 10 while operating the drain device 22 to discharge water in the washing tub for the preset time has been taken as an example. However, the control unit 30 may detect a measurement error of the water level sensor 10 while operating the water supply device 21 to supply water into the washing tub for a preset time.

Furthermore, the control unit 30 may detect a measurement error of the water level sensor 10 while controlling the water supply and drain device 20 to supply water into the washing tub or discharge water from the washing tub according to a first water level measured by the water level sensor 10 at a time at which the washing machine is driven.

That is, when the first water level measured by the water level sensor 10 is equal to or greater than a preset water level, the control unit 30 may operate the drain device 22 to discharge water from the washing tub for a preset time, and when the first water level is less than the preset water level, the control unit 30 may detect a measurement error of the water level sensor 10 while operating the water supply device 21 to supply water into the washing tub for a preset time.

The preset water level may be selected in various manners by the user or according to the designer's intention. For example, the preset water level may be selected as a washing water level.

When it is determined using the water level sensor 10 that water is in the washing tub, the control unit 30 may receive the water level from the water level sensor 10 in real time, while operating the drain device 22 to discharge the water from the washing tub, or operating the water supply device 21 to supply water to the washing tub.

When the water level provided by the water level sensor 10 in real time does not change, the control unit 30 causes the output unit 40 to display a measurement error of the water level sensor 10.

When the water level does not change, it does not indicate that the first water level measured through the water level sensor 10 is physically and/or mathematically equal to the water level measured by the water level sensor 10 in real time, but indicates that the water level is in a range in which it may be considered that the water level has not changed, thereby indicating a measurement error or the like. Such a range may be selected in various manners by the user or according to the designer's intention.

On the other hand, when the water level provided by the water level sensor 10 in real time changes, the control unit 30 controls the water supply and drain device 20 to supply or discharge water at a level for washing, and then performs a washing process.

The output unit 40 serves to output or display the measurement error of the water level sensor 10, which is detected by the control unit 30. The output unit 40 may display the measurement error of the water level sensor 10 in various manners.

Referring to FIG. 2, the output unit 40 may include a separate measurement error lamp 70 to display a measurement error of the water level sensor 10.

Referring to FIG. 3, the output unit 40 may control a flickering method in a water level display window 80 to display a measurement error. That is, the output unit 40 may uniformly or sequentially control the water level display window 80 to inform a user that a measurement error occurred.

Referring to FIG. 4, the output unit 40 may include a separate LCD window 90 to display a measurement error of the water level sensor 10 using text or the like.

In accordance with an embodiment of the present invention, when water remaining in the air trap is frozen or the pressure of the air trap has changed, the output unit 40 displays that the water level measured by the water level sensor 10 is different from the actual water level in the washing tub, thereby informing the user of a measurement error of the water level sensor 10.

Figure 5:
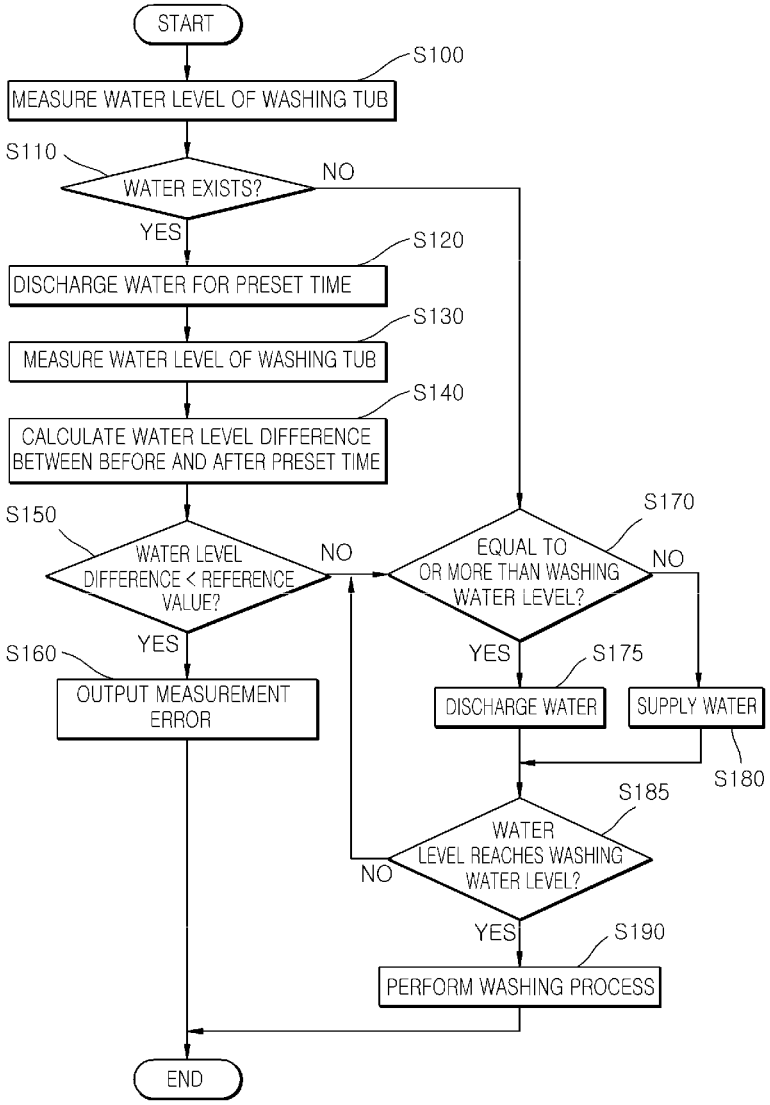
FIG. 5 is a flowchart illustrating a method for detecting an error in the measurement of a water level in a washing machine in accordance with an embodiment of the present invention.

FIG. 5 is a flowchart illustrating a method for detecting an error in the measurement of the water level in a washing machine in accordance with an embodiment of the present invention.

First, the water level sensor 10 measures a water level in the washing tub, and the control unit 30 receives the measured water level from the water level sensor 10, at step S100.

Then, the control unit 30 determines whether or not water is in the washing tub, using the water level sensor 10, at step S110. When water exists, the control unit 30 operates the drain device 22 to discharge the water from the washing tub for a preset time, at step S120.

After the water is discharged for the preset time, the control unit 30 receives the water level in the washing tub from the water level sensor 10 at step S130, and calculates a difference of the water levels before and after the preset time at step S140.

Then, the control unit 30 compares the water level difference before and after the preset time to a reference value at step S150. When the water level difference is less than the reference value, it may indicate that the water level sensor 10 is not measuring the actual water level change in a normal manner. In this case, the control unit 30 controls the output unit 40 to display a measurement error at step S160.

On the other hand, when the water level difference is equal to or greater than the reference value, it may indicate that the water level sensor 10 is operating normally to measure the actual change in the water level. In this case, the control unit 30 controls the water supply and drain device 20 to supply or discharge water until the water is at a level for washing, and then performs a washing process, at steps S170 to S190.

Furthermore, when it is determined at step S110 that no water is in the washing tub, the control unit 30 controls the water supply device 21 to supply water to a level for washing, and then performs a washing process, at step S170 to S190.

At step S120, in which the control unit 30 controls the drain device 22 to discharge water from the washing tub for the preset time, the control unit 30 may instead operate the water supply device 21 to supply water into the washing tub for a preset time.

In accordance with an embodiment of the present invention, it is possible to detect a measurement error of the water level sensor 10, while controlling an actual water level in the washing tub by supplying or discharging a small amount of water.

Figure 6:
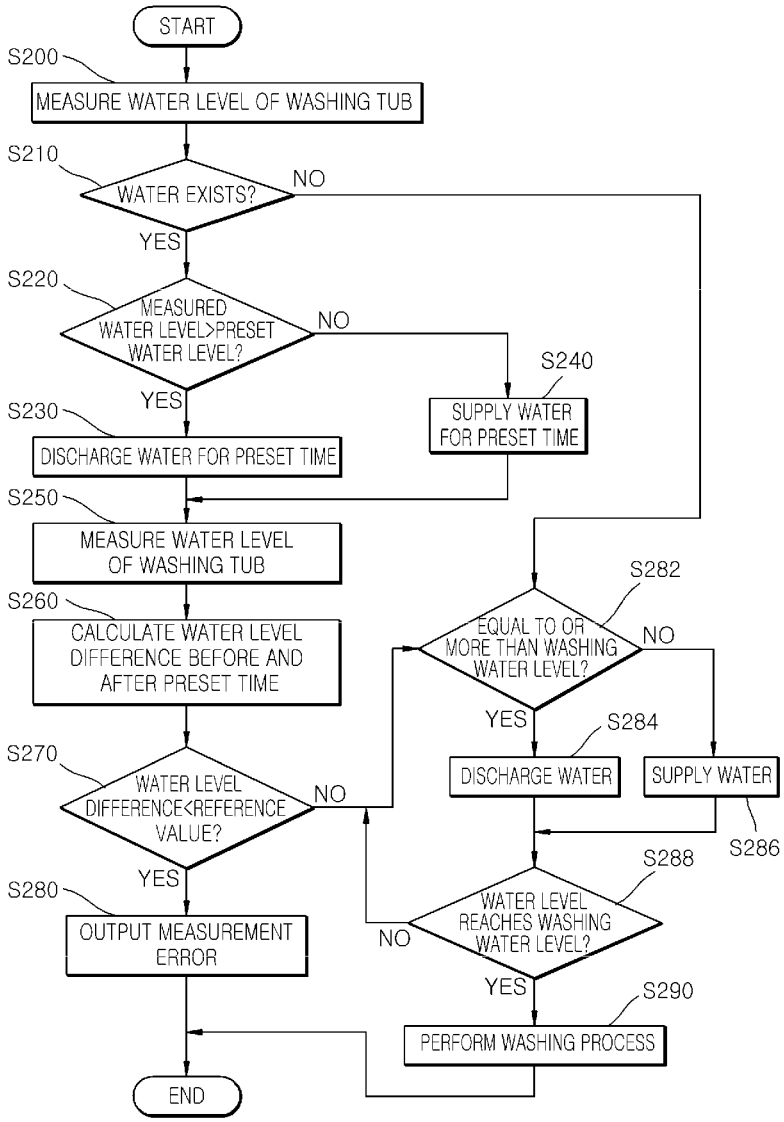
FIG. 6 is a flowchart illustrating a method for detecting an error in the measurement of a water level in a washing machine in accordance with another embodiment of the present invention.

FIG. 6 is a flowchart illustrating a method for detecting an error in the measurement of a water level in a washing machine in accordance with another embodiment of the present invention.

First, the water level sensor 10 measures a water level in the washing tub, and the control unit 30 receives the water level from the water level sensor 10, at step S200.

Then, the control unit 30 determines whether or not water is in the washing tub, using the water level sensor 10, at step S210. When water is in the washing tub, the control unit 30 compares the water level measured by the water level sensor 10 to a preset water level at step S220.

When the water level measured by the water level sensor 10 is higher than the preset water level, the control unit 30 operates the drain device 22 to discharge water from the washing tub for a preset time at step S230.

On the other hand, when the water level measured by the water level sensor 10 is equal to or less than the preset water level, the control unit 30 operates the water supply device 21 to supply water to the washing tub for a preset time at step S240.

After water is discharged or supplied for the preset time, the control unit 30 receives a water level in the washing tub from the water level sensor 10 at step S250, and calculates a difference of the water levels before and after the preset time at step S260.

Then, the control unit 30 compares the water level difference before and after the preset time to a reference value at step S270. When the water level difference is less than the reference value, it may indicate that the water level sensor 10 is not measuring an actual water level change in a normal manner. Thus, the control unit 30 causes the output unit 40 to display a measurement error at step S280.

On the other hand, when the water level difference is equal to or greater than the reference value, it may indicate that the water level sensor 10 is operating normally to measure the actual water level changes. Thus, the control unit 30 controls the water supply and drain device 20 to supply or discharge water to a level for washing, and then performs a washing process at steps S282 to S290.

When it is determined at step S120 that no water is in the washing tub, the control unit 30 controls the water supply device 21 to supply water to a level for washing, and then performs a washing operation at steps S282 to S290.

As such, when the operation of comparing the first water level in the washing tub to the preset level to selectively supply water to the washing tub or discharge water from the washing tub, it is possible to reduce the amount of water to be supplied or discharged at the level for washing when it is determined that the water level sensor 10 is operating normally to measure the actual change in water level.

Figure 7:
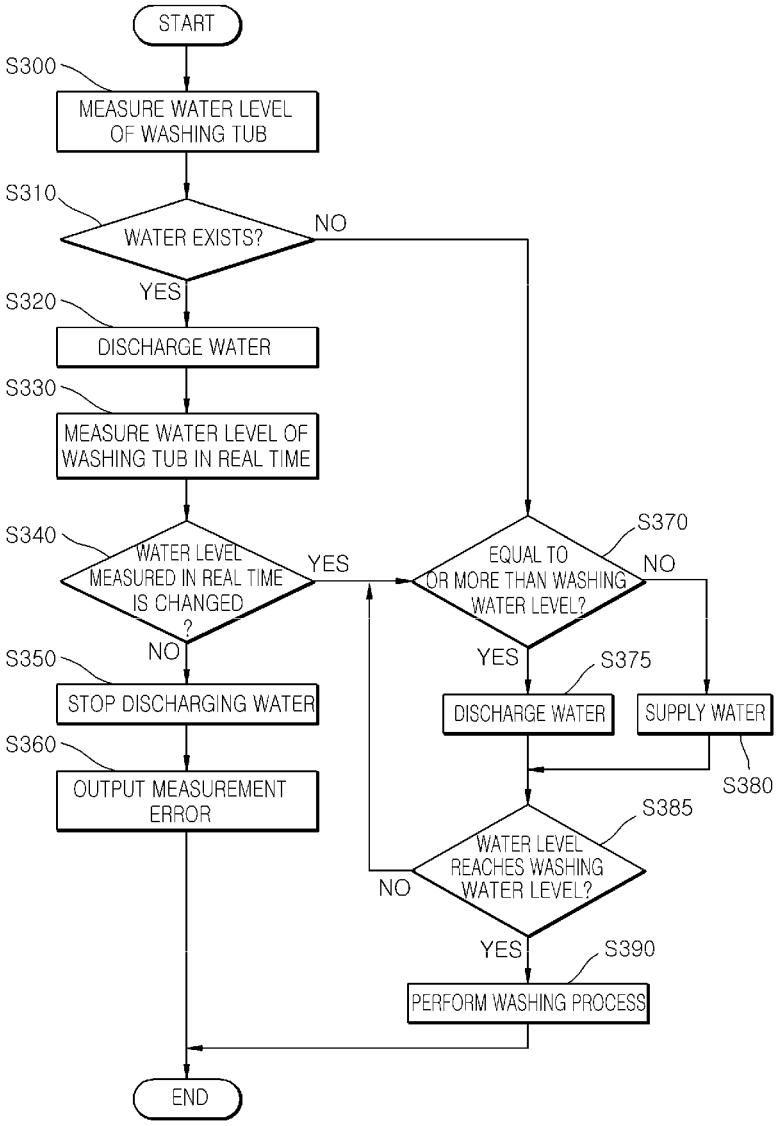
FIG. 7 is a flowchart illustrating a method for detecting an error in the measurement of a water level in a washing machine in accordance with another embodiment of the present invention.

FIG. 7 is a flowchart illustrating a method for detecting an error in the measurement of a water level in a washing machine in accordance with another embodiment of the present invention.

First, the water level sensor 10 measures a water level in the washing tub, and the control unit 30 receives the measured water level from the water level sensor 10, at step S300.

Then, the control unit 30 determines whether or not water is in the washing tub, using the water level sensor 10, at step S310. When water is in the washing tub, the control unit 30 operates the drain device 22 to discharge the water from the washing tub at step S320.

While the water is discharged, the control unit 30 receives the water level in the washing tub from the water level sensor 10 in real time at step S330, and determines whether or not the water level in real time has changed, at step S340.

When the water level inputted from the water level sensor 10 in real time has not changed, it may indicate that the water level sensor 10 is not measuring the actual water level changes in a normal manner. Thus, the control unit 30 controls the drain device 22 to stop discharging the water at step S350. Then, the control unit 30 causes the output unit 40 to display a measurement error at step S360.

On the other hand, when the water level from the water level sensor 10 in real time changes, it may indicate that the water level sensor 10 is operating normally to measure actual water level changes. Thus, the control unit 30 controls the water supply and drain device 20 to supply or discharge water to a level for washing, and then performs a washing process at steps S370 to S390.

Furthermore, when it is determined at step S310 that no water is in the washing tub, the control unit 30 controls the water supply device 21 to supply water to the level for washing, and then performs a washing process at steps S370 to S390.

At step S320, in which the control unit 30 operates the drain device 22 to discharge water from the washing tub, the control unit 30 may instead operate the water supply device 21 to supply water into the washing tub.

When a measurement error of the water level sensor 10 is detected according to the water level change measured in real time, it is possible to quickly detect whether or not a measurement error occurs before a preset time passes.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

The invention claimed is:

1. An apparatus for detecting an error in a measurement of a water level in a washing machine, comprising:

a water level sensor measuring a water level in a washing tub;

a water supply device supplying water into the washing tub;

a drain device discharging water from the washing tub; and a control unit controlling the water supply device and the drain device to adjust an actual water level in the washing tub, and detecting a measurement error of the water level sensor based on a water level change measured by the water level sensor while the actual water level is adjusted, wherein the control unit compares a first water level measured by the water level sensor to a preset water level, and controls the drain device to discharge the water in the washing tub for a preset time when the first water level is higher than the preset water level, or controls the water supply device to supply water to the washing tub for the preset time when the first water level is equal to or lower than the preset water level, and wherein the control unit detects the measurement error of the water level sensor when a water level measured by the water level sensor in real time has not changed, and wherein the control unit controls the water supply device and the drain device for a preset time, and detects the measurement error of the water level sensor when a calculated water level difference between the first water level measured before the preset time and a second water level measured after the preset time is less than a reference value.

2. A method for detecting an error in a measurement of a water level in a washing machine, comprising:

receiving in a control unit a water level in a washing tub from a water level sensor;

adjusting an actual water level in the washing tub by controlling a water supply device to supply water to the washing tub or a drain device to discharge water from the washing tub, when water is in the washing tub; and detecting a measurement error of the water level sensor from a water level change measured by the water level sensor, while the actual water level is adjusted, wherein adjusting the actual water level in the washing tub comprises:

comparing a first water level measured by the water level sensor to a preset water level; and selectively controlling the water supply device to supply water to the washing tub or the drain device to discharge water from the washing tub according to the comparison result, wherein in controlling the water supply device and the drain device, when the first water level is higher than the preset water level, the water in the washing tub is discharged, and when the first water level is equal to or lower than the preset water level, additional water is supplied to the washing tub, and wherein detecting the measurement error of the water level sensor comprises:

receiving the water level in the washing tub from the water level sensor in real time, while adjusting the actual water level; and outputting the measurement error of the water level sensor, when the water level from the water level sensor in real time has not changed;

calculating a water level difference between the first water level measured before the actual water level is adjusted and a second water level measured after the actual water level is adjusted; and outputting the measurement error of the water level sensor when the water level difference is less than a reference level.

* * * * *